US011780662B2

(12) United States Patent
Shiotani et al.

(10) Patent No.: US 11,780,662 B2
(45) Date of Patent: Oct. 10, 2023

(54) CAN LID

(71) Applicant: Daiwa Can Company, Chiyoda-ku (JP)

(72) Inventors: Masahiro Shiotani, Sagamihara (JP); Tomohiko Oyanagi, Chiyoda-ku (JP)

(73) Assignee: Daiwa Can Company, Chiyoda-ku (JP)

( * ) Notice: Subject to any disclaimer, the term of this patent is extended or adjusted under 35 U.S.C. 154(b) by 338 days.

(21) Appl. No.: 17/259,314

(22) PCT Filed: Apr. 18, 2019

(86) PCT No.: PCT/JP2019/016609
§ 371 (c)(1),
(2) Date: Jul. 8, 2021

(87) PCT Pub. No.: WO2020/012749
PCT Pub. Date: Jan. 16, 2020

(65) Prior Publication Data

US 2021/0339935 A1 Nov. 4, 2021

(30) Foreign Application Priority Data

Jul. 12, 2018 (JP) ..... 2018-132192

(51) Int. Cl.
*B65D 79/00* (2006.01)
*B65D 43/14* (2006.01)
*B65D 51/16* (2006.01)

(52) U.S. Cl.
CPC ..... *B65D 79/0087* (2020.05); *B65D 43/14* (2013.01); *B65D 51/1638* (2013.01)

(58) Field of Classification Search
CPC ..... B65D 79/0087; B65D 43/14; B65D 51/1638; B65D 17/08; B65D 2213/00;
(Continued)

(56) References Cited

U.S. PATENT DOCUMENTS 6,419,110 B1 7/2002 Stodd
7,556,168 B2 * 7/2009 Turner ..... B65D 17/4012 220/619

(Continued)

FOREIGN PATENT DOCUMENTS

CN 1524049 A 8/2004
CN 101014515 A 8/2007

(Continued)

OTHER PUBLICATIONS

International Search Report dated Jul. 30, 2019 in PCT/JP2019/016609 filed on Apr. 18, 2019.

*Primary Examiner* — Kareen K Thomas
(74) *Attorney, Agent, or Firm* — Oblon, McClelland, Maier & Neustadt, L.L.P.

(57) ABSTRACT

A can lid is provided for excellence in an explosion-proof function and a suitability for a hammering inspection. A buckling-inducing section that is easily deformed angularly is formed on a plurality of sites in a circumferential portion of a panel section. A score line intersects with a virtual line passing through a center of the panel section and a center of the buckling-inducing section. End portions of the score line are situated closer to the center of the panel section than a virtual boundary line extending perpendicular to the virtual line. A circular depression is formed at the center of the panel section. A slant wall section is formed between the buckling-inducing section and an inner side wall, and the slant wall section is joined to the inner side wall through a curved portion.

4 Claims, 5 Drawing Sheets

(58) Field of Classification Search
CPC .... B65D 17/28; B65D 43/06; B65D 77/2028; B65D 77/10; B65D 77/14; B65D 2517/0092; B65D 2577/2041; B65D 51/007
See application file for complete search history.

(56) References Cited

U.S. PATENT DOCUMENTS

| | | | | |
|---|---|---|---|---|
| 7,938,290 | B2 * | 5/2011 | Bulso | B65D 7/04 220/619 |
| 8,011,527 | B2 * | 9/2011 | Forrest | B65D 17/4012 220/651 |
| 8,287,220 | B2 * | 10/2012 | Oberholzer | B21D 51/443 220/254.1 |
| 8,328,492 | B2 * | 12/2012 | Turner | B65D 17/502 413/8 |
| 8,534,485 | B2 * | 9/2013 | Van Jaarsveld | B65D 17/4011 220/619 |
| 8,875,936 | B2 * | 11/2014 | Turner | B65D 17/4012 220/619 |
| 8,973,780 | B2 * | 3/2015 | Forrest | B65D 7/40 220/624 |
| 8,998,015 | B2 * | 4/2015 | Williams | B65D 17/4011 220/272 |
| 2003/0010785 | A1 | 1/2003 | Stodd | |
| 2004/0065663 | A1 * | 4/2004 | Turner | B65D 17/502 220/254.1 |
| 2005/0006388 | A1 * | 1/2005 | Turner | B65D 17/06 220/619 |
| 2009/0223956 | A1 | 9/2009 | Matsukawa et al. | |
| 2010/0006571 | A1 | 1/2010 | Shibasaka et al. | |
| 2011/0308202 | A1 * | 12/2011 | Hall | B65D 17/4011 220/270 |
| 2014/0263327 | A1 | 9/2014 | Chasteen et al. | |
| 2021/0339935 | A1 | 11/2021 | Shiotani et al. | |

FOREIGN PATENT DOCUMENTS

| | | | |
|---|---|---|---|
| CN | 101678917 | A | 3/2010 |
| CN | 102514808 | A | 6/2012 |
| CN | 105164020 | A | 12/2015 |
| CN | 211168066 | U | 8/2020 |
| EP | 0 663 346 | A1 | 7/1995 |
| JP | 9-10874 | A | 1/1997 |
| JP | 2000-85768 | A | 3/2000 |
| JP | 2004-17977 | A | 1/2004 |
| JP | 2004-238071 | A | 8/2004 |
| JP | 2005-119747 | A | 5/2005 |
| JP | 2006-335459 | A | 12/2006 |
| JP | 2008-265869 | A | 11/2008 |

* cited by examiner

FIG. 6

| STRUCTURE OF CAN LID | | | | BLOW-OFF | OCCURRENCE OF BUCKLING (RATING OF LARGENESS OF BUCKLING AREA) | NUMBER OF ANGULAR DEFORMATION | RATING OF EXPLOSION-PROOF FUNCTION | SUITABILITY FOR HAMMERING INSPECTION |
|---|---|---|---|---|---|---|---|---|
| NO. | SLANT WALL SECTION 10 | CIRCULAR DEPRESSION | POSITIONS OF END PORTIONS OF SCORE LINE | | | | | |
| EXAMPLE | FORMED | FORMED | EXCEED | NONE | OCCURRED (1) | OCCURRED (1) | 1 | ○ |
| 1ST COMPARATIVE EXAMPLE | FORMED | FORMED | SHORT | NONE | OCCURRED (3) | OCCURRED (2) | 3 | ○ |
| 2ND COMPARATIVE EXAMPLE | FORMED | NONE | EXCEED | NONE | OCCURRED (4) | OCCURRED (3) | 4 | × |
| 3RD COMPARATIVE EXAMPLE | NONE | FORMED | EXCEED | NONE | OCCURRED (2) | OCCURRED (2) | 2 | ○ |
| 4TH COMPARATIVE EXAMPLE | NONE | NONE | SHORT | OCCURRED | OCCURRED (5) | OCCURRED (4) | 5 | × |

CAN LID

TECHNICAL FIELD

The present invention relates to a can lid that is attached to an opening of a can trunk.

BACKGROUND ART

A can lid as a closure of a can container should be adapted to prevent explosion of the can container, and suited to undergo a hammering inspection. In order to determine quality of a canned product, a degree of vacuum in the can container, a seaming quality of the can lid, a content in the can container and so on are inspected by the hammering inspection. Specifically, those factors are inspected based on a (frequency of) sound produced by hammering the can lid. To this end, the can lid has to be vibrated in such a manner as to accurately reflect the conditions of the canned product. In addition, in order to prevent a seamed potion from being broken and to prevent the cap from being blown off in the event of a pressure rise in the can container, the can lid is designed to have an explosion-proof function to reduce the internal pressure of the canned product by venting gas or content from the canned product.

The patent document 1 discloses a can lid suited to undergo the hammering inspection. The can lid described therein comprises an annular groove formed on an outer circumference of a panel, a chuck wall formed around the annular groove, a bead formed inside of the annular groove, and a depressed panel section formed by (inwardly) depressing a central region in a circular manner. When an internal pressure of a canned product closed by the can lid is raised as a result of applying e.g., a retort treatment to the canned product, the depressed panel section is inflated (i.e., curved) outwardly, and a portion of the panel between the depressed panel section and the bead is also inflated (i.e., curved) outwardly along the bead. Then, when the internal pressure is reduced, the depressed panel section and the portion of the panel between the depressed panel section and the bead returns to original shapes. Since the can lid is not abnormally deformed and a rigidity thereof is not especially changed after returning to the original shape, the can lid is allowed to create a vibration sound to accurately reflect the conditions of the canned product when the can lid undergoes the hammering inspection after returning to the original shape. Thus, the can lid described therein is adapted to undergo the hammering inspection.

The patent document 2 discloses a can lid having an explosion-proof function. The can lid described therein comprises a chuck wall and an annular groove individually formed on an outer circumference of a panel, buckling-inducing sections formed on a plurality of sites (i.e., four sites) around the panel, and a score line passing through the buckling-inducing sections. Specifically, the buckling-inducing section is formed by coining a predetermined small area of the panel to reduce a thickness thereof, and by pushing the area to which the coining is applied outwardly. When an internal pressure of a canned product to which the can lid is attached is raised, the buckling-inducing sections and the vicinity thereof are buckled outwardly prior to the remaining section. Since a score line passes through the buckling-inducing sections to be deformed, the score line is easy to be ruptured by a tension resulting from the deformation of the buckling-inducing sections. According to the teachings of the patent document 2, therefore, the internal pressure of the canned product can be reduced by the rupture of the score line. For this reason, it is possible to prevent a seamed potion from being broken and to prevent a cap from being blown off.

PRIOR ART DOCUMENT

Patent Literature

Patent Document 1: JP 2004-17977 A.
Patent Document 2: JP 2004-238071 A.

SUMMARY OF INVENTION

Technical Problem to be Solved by the Invention

A canned product is required to be adapted not only to undergo the hammering inspection but also to have an explosion-proof function, depending on its content. However, in the can lid described in the patent document 1, rigidity of a circumferential portion of the panel is increased by the bead. Therefore, a deformation load established by the internal pressure may be applied to the seamed portion without being relaxed. That is, the can lid described in the patent document 1 does not have a function to reduce the internal pressure or relax the load applied to the seamed portion. Therefore, the explosion-proof function may be insufficient and a cap may be blown off easily. On the other hand, in the can lid described in the patent document 2, the panel is allowed to be deformed easily by the buckling-inducing section. However, if the panel is inflated by a pressure rise resulting from the retort treatment, the inflated panel will not return easily to the original shape. According to the teachings of the patent document 2, therefore, abnormal vibrations and noises different from those of a normal product may be generated by hammering the panel. As a result, the determination of defective product may be made erroneously.

The present invention has been conceived noting the foregoing technical problems, and it is therefore an object of the present invention to provide a can lid having an explosion-proof function that is suited to undergo the hammering inspection,

Means for Solving the Problem

According to the present invention, there is provided a can lid, comprising: an annular groove that is depressed toward an inner surface of a panel section around the panel section; a chuck wall that is formed around the annular groove while extending higher than an outer surface of the panel section; and a flange that is formed on a leading edge of the chuck wall while being curled to be seamed to an opening end a can trunk. In order to achieve the above-explained objective the can lid is provided with a buckling-inducing section that is thinned to be easily deformed angularly to protrude outwardly, and that is formed on a plurality of sites in a circumferential portion of the panel section close to the annular groove; and a score line that intersects with a virtual line passing through a center of the panel section and a center of the buckling-inducing section, and that is easily to be ruptured. In the can lid, both end portions of the score line are situated closer to the center of the panel section than a virtual boundary line that is drawn perpendicular to the virtual line while passing through an end portion of the buckling-inducing section. In addition, a circular depression that is depressed toward the inner surface of the panel section is formed at the center of the panel section, in such a manner that a radius of the circular depression reaches neither the score line nor the buckling-inducing section. Further, a slant wall section is formed between an outer end of the buckling-inducing section in a radial direction of the panel section and an inner side wall of the annular groove. Furthermore, the slant wall section is joined to the inner side wall through a curved portion having a predetermined curvature radius to protrude outwardly from the panel section.

In addition, according to the present invention, each intersection between the score line and the virtual line may be individually situated on the panel section radially outer side of the center of the buckling-inducing section on the virtual line.

Further, according to the present invention, the curvature radius of the curved portion may be set to 0.5 mm or longer.

Advantageous Effects of Invention

According to the present invention, the buckling-inducing sections are formed on the outer circumferential portion of the panel section instead of a bead so that the panel section is deformed easily by an internal pressure of the can container. Therefore, when the internal pressure is raised excessively, an angular deformation is caused at the buckling-inducing sections to reduce the internal pressure. As a result, it is possible to prevent a seamed portion from being broken. In other words, an explosion-proof function to prevent an occurrence of a blow-off may be improved. In addition, since the line connecting the end portions of the score line extends on a flat portion without passing through the buckling-inducing section, the deformation starts along the line connecting the end portions to rupture the score line easily to depressurize the can container. In other words, since the internal pressure can be reduced easily, the explosion-proof function may be ensured even if a rigidity of the buckling-inducing section or the circumferential portion of the panel section is slightly increased. Therefore, even if the internal pressure is raised temporarily by a retort treatment or the like, the panel section is allowed to return to the original shape. Therefore, a suitability of the can lid to undergo a hammering inspection may be improved to evaluate quality of the can container based on vibrations and sounds created by hammering the can lid. Thus, not only the explosion-proof function but also the suitability for the hammering inspection may be improved.

In addition, according to the present invention, the slant wall section is formed between the outer end of the buckling-inducing section and the inner side wall of the annular groove, and the slant wall section is joined to the inner side wall through the curved portion having a predetermined curvature radius. Therefore, a resistance against the deformation of the buckling-inducing section, that is, the rigidity of the buckling-inducing section is reduced so that the buckling may be induced as intended. That is, the explosion-proof function of the can lid may be improved. Especially, since the curvature radius of the curved portion is set to 0.5 mm or longer, the angular deformation of the buckling-inducing section may be induced certainly.

Further, according to the present invention, the intersections between the score line and the virtual line are situated on the panel section radially outer side of the center of the buckling-inducing section on the virtual line. Therefore, a distance between the score line and the line connecting the end portions of the score line may be ensured sufficiently long. Therefore, the deformation is induced along the line connecting the end portions of the score line so that the score line may be ruptured easily. For this reason, even if the buckling-inducing section is inflated due to pressure rise, the score line may be ruptured easily to depressurize the can container. That is, the explosion-proof function of the can lid may be improved.

BRIEF DESCRIPTION OF DRAWINGS

FIG. 6 is a table showing evaluation results of a comparison experiment between the example of the present invention and comparative examples.

DESCRIPTION OF EMBODIMENT(S)

Figure 1:
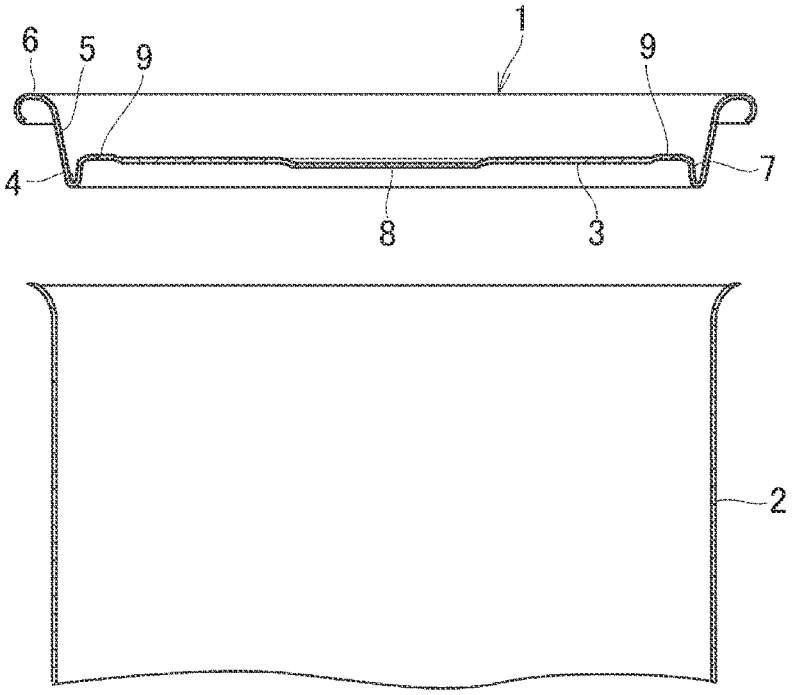
FIG. 1 is a cross-sectional view showing one example of a structure of a can lid according to the present invention.

As illustrated in FIG. 1, a can lid 1 according to the present invention is a panel member made of metal plate material, and the can lid 1 is seamed to an opening end of a can trunk 2 to close the opening end of a can trunk 2. The can lid 1 may be seamed e.g., to the can trunk 2 of a bottle-shaped can container or a three-piece can container on which a cap is mounted. For example, the metal plate material includes an aluminum plate such a pure aluminum plate and an aluminum alloy plate, and a steel plate such as an electrolytic chromate-treated steel plate, a nickel-plated steel plate, and a tin-plated steel plate. In addition, it is preferable to coat at least an inner surface of the metal plate material with a coating material such as epoxy-phenol resin, epoxy-acrylic rein, vinyl-chloride resin, or a thermoplastic resin film formed of at least one of polyethylene, polypropylene, polyester, polyamide, ionomer and so on.

Figure 2:
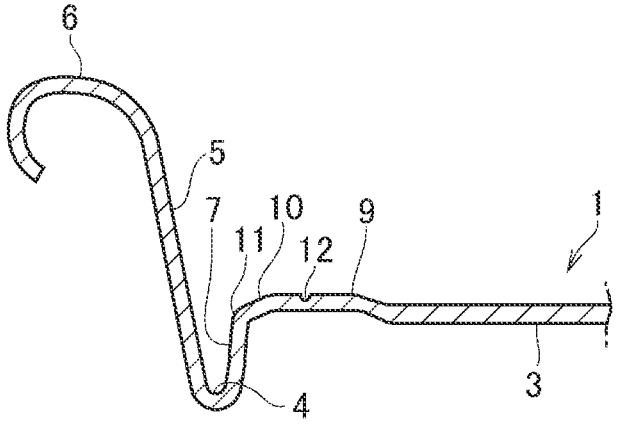
FIG. 2 is a partial cross-sectional view showing a structure of a section in the vicinity of an annular groove.

The fundamental structure of the can lid 1 is known in the art, and the can lid 1 comprises a panel section 3 substantially serving as a lid, a seaming section, and a reinforcement section. The panel section 3 is a circulate plate portion whose diameter is slightly smaller than an inner diameter of a can trunk 2, and in the can lid 1, an annular groove 4, a chuck wall 5, and a flange 6 are formed radially outer section of the panel section 3. As illustrated partially in an enlarged scale in FIG. 2, the annular groove 4 is depressed toward the inner surface of the panel section 3, and the annular groove 4 is formed entirely around the panel section 3 between the chuck wall 5 and an inner side wail 7 formed closer to a center of the panel section 3 than the chuck wall 5. The chuck wall 5 is a side wall extending from a bottom of the annular groove 4 toward an outer surface (i.e., an upper surface) of the panel section 3 while expanding obliquely outwardly, and a leading edge (i.e., an upper edge) of the chuck wall 5 is curled to form the flange 6.

According to the present invention, the explosion-proof function of the can lid 1 is enhanced, and the can lid 1 is adapted to undergo the hammering inspection. In order to undergo the hammering inspection properly, a circular depression 8 is formed at the center of the panel section 3. The circular depression 8 corresponds to the depressed panel section described in the patent document 1 (JP 2004-17977 A), and a structure of the circular depression 8 is similar to that of the depressed panel section. The circular depression 8 is depressed in a circular manner, and a depth of the circular depression 8 is shallower than a depth of the annular groove 4. Specifically, the depth of the circular depression 8 may be set within a range from 130 to 250% of a thickness of the panel section 3, and preferably, the depth of the circular depression 8 is set to approximately 213% of the thickness of the panel section 3. For example, the depth of the circular depression 8 may be set within a range from 0.4 to 0.7 mm, and preferably, the depth of the circular depression 8 is set to 0.65 mm. A boundary between the circular depression 8 and the panel section 3 is shaped into a curved wall depressing toward the inner surface of the panel section 3 (i.e., protruding inwardly). Given that an average value between a maximum diameter and a minimum diameter of the curved wall is a diameter of the circular depression 8, the diameter of the circular depression 8 may be set within a range from 41 to 46% of an outer diameter of the panel section 3, and preferably, the diameter of the circular depression 8 is set to approximately 44% of the outer diameter of the panel section 3. For example, the diameter of the circular depression 8 may be set within a range from 17.5 to 21.0 mm, and preferably, the diameter of the circular depression 8 is set to 20.0 mm.

A central section of the circular depression 8 is substantially flat. A diameter of the central flat section (that is, the minimum diameter of the curved wall) of the circular depression 8 may be set within a range from 26 to 30% of the outer diameter of the panel section 3, and preferably, the diameter of the flat center section is set to approximately 28% of the outer diameter of the panel section 3. For example, the diameter of the flat center section is set within a range from 12.0 to 14.0 mm, and preferably, the diameter of the flat center section is set to 12.9 mm.

Figure 3:
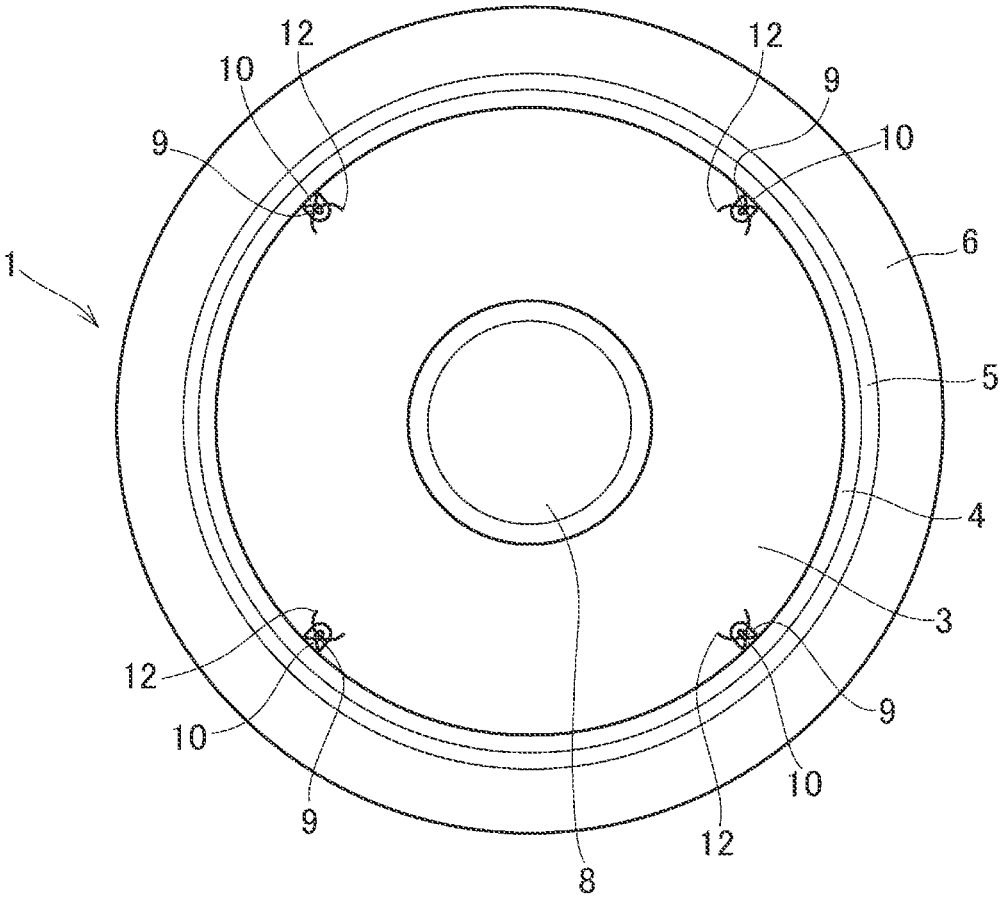
FIG. 3 is a plan view showing the can lid shown in FIG. 1.

In order to prevent the cap from being blown off, according to the present invention, the can lid 1 is provided with a buckling-inducing section 9. A definition of the buckling is a deformation (or inflation) of the can lid 1 to protrude outwardly partially or entirely. In the event of an occurrence of the buckling, an interior volume of the can container is increased thereby reducing an internal pressure of the can container. As a result, the cap can be prevented from being blown off, and the seamed portion can be prevented from being broken. Such buckling is caused at the buckling-inducing section 9, and as illustrated in FIG. 3, a plurality of the buckling-inducing sections 9 is formed (at four sites at regular intervals in the example sown in FIG. 3) on the can lid 1.

The buckling-inducing section 9 is formed by applying a coining to the panel portion to partially reduce a thickness of the panel section 3 at a portion of close to the annular groove 4, and pushing the thinned portion toward the outer surface of the panel section 3. A shape of the buckling-inducing section 9 may be selected from an appropriate shape such as a circular shape, an ovel shape, and an elliptical shape (that is, round shapes), and an area of the buckling-inducing section 9 is approximately within a range from 1 to 2 $mm^2$. In the example shown in FIG. 3, the buckling-inducing section 9 is shaped into an ovel or elliptical shape in which a long axis extends in a radial direction of the panel section 3. A thickness of the buckling-inducing section 9 may be set within a range from 80 to 96% of the thickness of the panel section 3. Specifically, the thickness of the buckling-inducing section 9 may be set within a range from 0.20 to 0.30 mm, and a projection height of the buckling-inducing section 9 from e panel section 3 toward the outer surface is set within a range from 0.15 to 0.20 mm.

Figure 4:
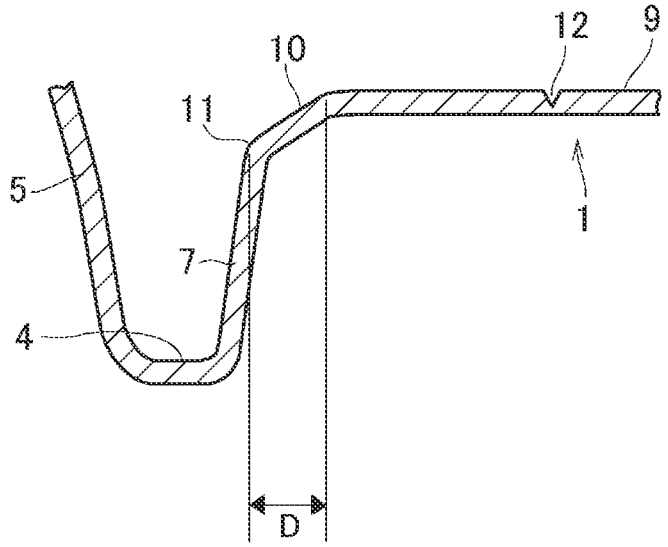
FIG. 4 is an enlarged cross-sectional view showing a cross-section of a section where a buckling-inducing section and a slant wall section are formed.
Figure 5:
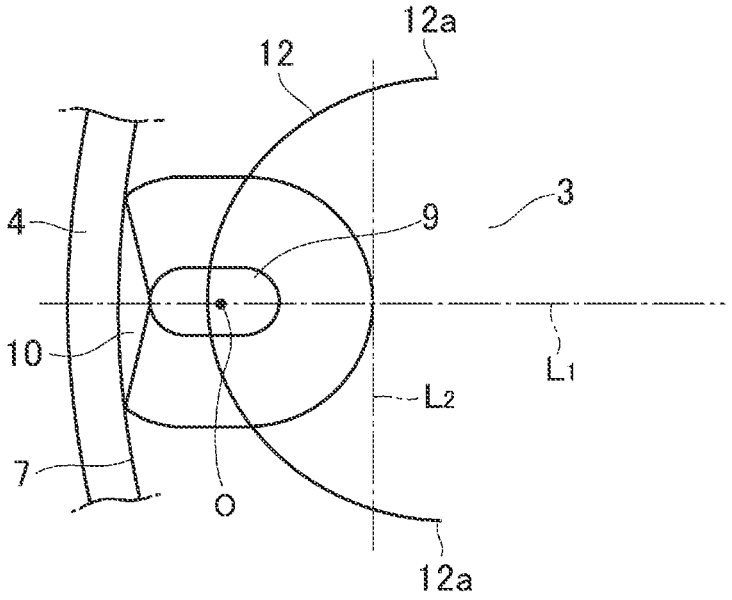
FIG. 5 is an enlarged plan view showing the buckling-inducing section.

As illustrated in FIGS. 4 and 5, each of the buckling-inducing sections 9 is formed on slightly inner side of the inner side wall 7. In order to expedite buckling by reducing rigidity of a portion around the buckling-inducing section 9, it is preferable to maintain a distance D between the inner side wall 7 and the buckling-inducing sections 9 to 1 mm or longer. A slant wall section 10 is formed between the inner side wall 7 and an outer end of the buckling-inducing section 9 in the radial direction of the panel section 3. The slant wall section 10 is a flat portion formed as a result of projecting the buckling-inducing section 9 (upwardly) from the outer surface of the panel section 3. Given that a plurality of the buckling-inducing sections 9 is formed on the panel section 3 in the circumferential direction at regular intervals, the slant wall section 10 is shaped into a tapered shape.

A curved portion 11 protruding outwardly from the panel section 3 is formed on a boundary between the slant wall section 10 and the inner side wall 7, and a curvature radius of the curved portion 11 is set to 0.5 mm or longer. That is, the above-mentioned distance D is a distance between: a flexion point between the curved portion 11 and the inner side wall 7; and a flexion point between the slant wall section 10 and the buckling-inducing sections 9. In order to prevent the seamed portion from being broken and to prevent the cap from being blown off in the event of a pressure rise in the can container to which the can lid 1 is attached, it is necessary to allow the buckling-inducing sections 9 to be deformed angularly in a preferential manner. To this end, the curvature radius of the curved portion 11 is set to 0.5 mm or longer. The reason why the buckling-inducing sections 9 is deformed preferentially by setting the curvature radius of the curved portion 11 to 0.5 mm or longer is still unknown. However, if the curvature radius of the curved portion 11 is shorter than 0.5 mm, the boundary between. the slant wall section 10 and the inner side wall 7 becomes too angular. Consequently, the rigidity of the portion around the buckling-inducing sections 9 is increased too high to induce the deformation of the buckling-inducing sections 9. By contrast, given that the curvature radius of the curved portion 11 is 0.5 mm or longer, the deformation of the curved portion 11 propagates to the boundary between the slant wall section 10 and the inner side wall 7, and further propagates to a portion of the inner side wall 7 in the vicinity of the boundary. In this case, therefore, it is considered that the buckling-inducing sections 9 is allowed to be deformed angularly in a preferential manner.

A score line 12 passes through each of the buckling-inducing sections 9. The score line 12 is a groove having a V-shaped cross-section that is formed on the outer surface of the panel section 3, and is ruptured easily by a tensile force derived from the deformation of the buckling-inducing sections 9. A depth or a residual thickness of each of the score lines 12 is set to a value at which the score line 12 is ruptured when the internal pressure of the can container is raised to a level at which the buckling is caused or higher, based on a result of experiment or simulation. The score line 12 may be drawn not only into a straight line but into as a curved line, and according to the example, each of the score lines 12 is drawn into a curved line. Both end portions 12*a* of the score line 12 individually extend outside of the buckling-inducing section 9 toward the center of the panel section 3 so that the end portions 12*a* are situated closer to the center of the panel section 3 than the buckling-inducing section 9 in the radial direction. Specifically, the end portions 12*a* of the score line 12 are situated closer to the center of the panel section 3 than a virtual boundary line L2 that is drawn perpendicular to a virtual line L1 passing through the center of the panel section 3 and a center O of the buckling-inducing section 9 (in both length direction and a width direction), while passing through an innermost portion of the buckling-inducing section 9. Concretely, the innermost portion of the buckling-inducing section 9 in the panel section 3 is a radially innermost portion of a bulging section inclined gradually from the panel section 3 toward the buckling-inducing section 9. That is, a line connecting the end portions 12*a* of the score line 12 does not pass through the buckling-inducing section 9 including the bulging section so that the deformation starts along the line connecting the end portions 12*a* to rupture the score line 12 easily.

Specifically, rupture of the score line 12 starts at a portion deformed most significantly. Therefore, the score line 12 is designed to be deformed easily, in other words, the score line 12 is designed to be ruptured easily. Specifically, the score line 12 is drawn in such a manner that each intersection between the score line 12 and the virtual line L1 is individually situated on the panel section 3 radially outer side of the center of the buckling-inducing section 9 on the virtual line L1.

When the internal pressure of the can container to which the can lid 1 is seamed is raised excessively due to generation of gas or temperature rise, the panel section 3 is inflated entirely. As described, a plurality of the buckling-inducing sections 9 is formed on predetermined sites of the panel section 3, and each of the buckling-inducing sections 9 protrudes individually from the panel section. In this situation, therefore, a stress derived from the deformation of the panel section 3 is concentrated on the buckling-inducing sections 9. In addition, since the thickness of each of the buckling-inducing sections 9 is reduced by the coining, the angular deformation is caused at the buckling-inducing sections 9 preferentially (or promptly). Further, in the can lid 1, the slant wall section 10 expanding from the buckling-inducing section 9 is joined to the inner side wall 7 of the annular groove 4 through the curved portion 11 whose curvature radius is large, and hence the rigidity of the portion around the buckling-inducing section 9 is reduced. Therefore, the deformation of the buckling-inducing section 9 is not hindered, and such deformation of the buckling-inducing section 9 propagates around the buckling-inducing section 9.

If the internal pressure of the can container is still high despite the occurrence of such buckling, the portions around the other buckling-inducing sections 9 are also deformed, and eventually, the panel section 3 will be inflated entirely. Consequently, a capacity of the can container is increased by the deformation of the panel section 3 to absorb the pressure rise. For this reason, it is possible to prevent the seamed portion from being broken and to prevent the cap from being blown off.

When the buckling-inducing section 9 is inflated outwardly, a tensile stress on the buckling-inducing section 9 or the panel section 3 is increased, and the score line 12 is subjected to a bending stress. As described, the score line 12 passes through the buckling-inducing section 9 that is thinned by the coining. Therefore, the score line 12 is ruptured preferentially by the tensile stress and the bending stress derived from the deformation of the buckling-inducing section 9 caused by the pressure rise. According to the present invention, in the can lid 1, the intersections between the score line 12 and the virtual line L1 are situated radially outer side of the center O of the buckling-inducing section 9. Therefore, an amount of deformation, the tensile stress, and the bending stress at the above-mentioned intersection can be increased. Especially, since the line connecting the end portions 12*a* of the score line 12 at which the buckling-inducing section 9 starts deforming does not pass through the buckling-inducing section 9 including the bulging section, the buckling-inducing section 9 may be deformed easily to rupture the score line 12. Therefore, the internal pressure of the can container can be relieved certainly when the buckling-inducing section 9 is inflated by the pressure rise in the can container. Since the internal pressure of the can container will not be further raised, the cap can be prevented from being blown off by the angular deformation of the buckling-inducing sections 9. That is, the explosion-proof function may be improved.

When the can container is heated by a retort treatment or the like, the internal pressure of the can container is raised to an extent, that the buckling will not be caused, but the panel section 3 is inflated also in this situation. Specifically, in the can lid 1 according to the present invention, the panel section 3 is inflated along an inner circumference of the annular groove 4 and along an inner circumference of the circular depression 8. Therefore, a total amount of a deformation from the inner circumference of the annular groove 4 and a deformation from the inner circumference of the circular depression 8 is smaller than an amount of deformation of a case in which the circular depression 8 is not formed on the panel section 3 and hence the panel section 3 is inflated entirely. For this reason, when the internal pressure of the can container is reduced upon termination of the heating treatment, the panel section 3 and the circular depression 8 are allowed to return certainly to the original shapes. That is, the deformation will not remain in the panel section 3 almost completely. Especially, according to the present invention, the slant wall section 10 and the curved portion 11 are formed in the can lid 1, and positions of the score line 12 and the end portions 12*a* of the score line 12 are specified in the can lid 1. Therefore, the buckling of the panel section 3 and the rupture of the score line 12 may be induced. For this reason, the explosion-proof function of the can lid 1 will not be reduced even if the rigidity of the circumferential portion of the panel section 3 is slightly increased. In other words, the rigidity of the circumferential portion of the panel section 3 as a boundary of inflation can be increased. According to the present invention, therefore, the panel section 3 may be inflated temporarily and returned to the original shape smoothly. For this reason, sounds and vibrations created by hammering non-defective can container are clearly different from sounds and vibrations created by hammering defective can containers. Thus, the can container to which the can lid 1 according to the present invention is attached is suited to undergo the hammering inspection.

Here will be explained comparison results between the can lid according to the example of the present invention and can lids according to comparative examples. In the comparison experiment, the can lid according to the example of the present invention was provided with all the foregoing features of the present invention, and the can lids according to comparative examples were not provided with all the foregoing features of the present invention. In order to conduct the comparison experiment, can containers to which the can lid according to the example of the present invention was attached respectively, and can containers to which the can lids according to the comparative examples were attached respectively, were prepared five pieces each. Specifically, the can lid according to the example and the can lids according to the comparative examples were individually attached to a bottom of a capped three-piece aluminum can whose content was 500 ml.

As the commercially available canned coffee, those can containers were filled with coffee and nitrogen, and then sealed. Those can containers were heated 20 minutes by a retort disinfection device to a range from 120 to 125 degrees C. As a result, internal pressures of those can containers were raised to 640 kPa at the highest. Then, the heated can containers ware cooled at room temperature, and underwent the hammering inspection after the internal pressure had been reduced equal to or lower than 160 kPa. Thereafter, an open-end side (i.e., a stay-on tab side) of each of the can containers was cut off, and each of the can containers was clamped on a pressure tester. On the pressure tester, the internal pressure of each of the can containers was raised to 700 kPa (i.e., 0.70 MPa) that is higher than 650 kPa (i.e., 0.65 MPa) at which the buckling starts (i.e., a buckling withstanding pressure).

While the internal pressure was raised (i.e., during execution of the pressure test), the explosion-proof function of each of the can lids ware evaluated based on an occurrence of blow-off, an occurrence of buckling, and the number of occurrences of angular deformation. In addition, suitability for the hammering inspection of the can lid was evaluated by comparing a frequency of vibrations (or sound) created by hammering the can lid after being subjected to the retort disinfection treatment with a frequency of vibrations (or sound) created by hammering the non-defective can lid. The evaluation result is shown in FIG. 6. In FIG. 6, "exceed" represents that both end portions 12*a* of the score line 12 extend beyond the virtual boundary line L2, "short" represents that both end portions 12*a* of the score line 12 do not extend beyond the virtual boundary line L2, "O" represents that the suitability for the hammering inspection is good, and "X" represents that the frequency of the vibrations was different from that of the non-defective can lid and hence the suitability for the hammering inspection was unsatisfactory.

As can be seen from the evaluation result, in the can lid according to the example of the present invention, the blow off was not caused in all of the can containers to which the can lid according to the example of the present invention was attached, and the buckling and the angular deformation occurred in only one can container to which the can lid according to the example of the present invention was attached. Thus, not only the explosion-proof function but also the suitability for the hammering inspection of the can lid according to the example of the present invention were excellent.

By contrast, in can lid according to the first comparative example, the end portions 12*a* of the score line 12 did not extend beyond the virtual boundary line L2. In the can lid according to the first comparative example, the blow off did not occur in all of the can containers. However, the buckling occurred in three can containers, and the angular deformation occurred in two can containers. Thus, the can lid according to the first comparative example has the explosion-proof function, but it would be deformed easily. That is, the explosion-proof function of the can lid according to the first comparative example was not as good as that of the can lid according to the example of the present invention. Here, the suitability for the hammering inspection of the can lid according to the first comparative example was as good as that of the conventional non-defective can lids.

In the can lid according to the second comparative example, the circular depression 8 was not formed. Since the circular depression 8 was not formed, the suitability for the hammering inspection of the can lid according to the second comparative example was not acceptable. Moreover, in the can lid according to the second comparative example, the buckling occurred in four can containers, and the angular deformation occurred in three can containers. However, the blow off did not occur in all of the can containers. Thus, the can lid according to the second comparative example would be deformed easier than the can lid according to the first comparative example, and the explosion-proof function thereof was insufficient.

In the can lid according to the third comparative example, the slant wall section 10 was not formed. In the can lid according to the third comparative example, the blow off did not occur in all of the can containers. However, the buckling occurred in two can containers, and the angular deformation occurred in two can containers. Thus, the can lid according to the third comparative example has the explosion-proof function, but it would be deformed easily. That is, the explosion-proof function of the can lid according to the third comparative example was not as good as that of the can lid according to the example of the present invention. Here, the suitability for the hammering inspection of the can lid according to the third comparative example was as good as that of the conventional non-defective can lids.

The can lid according to the fourth comparative example was not provided with all the features of the present invention. That is, in the can lid according to the fourth comparative example, the slant wall section 10 and the circular depression 8 were not formed, and the end portions 12*a* of the score line 12 did not extend beyond the virtual boundary line L2. In the can lid according to the fourth comparative example, the blow off occurred in at least in one of the can containers. Moreover, the buckling occurred in all can containers (i.e., in the five containers), and the angular deformation occurred in four can containers. Thus, the explosion-proof function of the can lid according to the fourth comparative example was absolutely in sufficient. In addition, since the circular depression 8 was not formed, the suitability for the hammering inspection of the can lid according to the fourth comparative example was also not acceptable.

Based on the evaluation result, improvements in the explosion-proof function and the suitability for the hammering inspection of the can lid according to the example of the present invention have been confirmed.

The present invention should not be limited to the foregoing example, and various changes can be made within the scope of claims.

REFERENCE SIGNS LIST

1: can lid; 2: trunk portion: 3: panel section; 4: annular groove; 5: chuck wall; 6: flange; 7: inner side wall; 8: circular depression; 9: buckling-inducing section; 10; slant wall section; 11: curved portion; 12: score line; 12*a*: end portion; L1: virtual line; L2: virtual boundary line.

The invention claimed is:

1. A can lid, comprising:

an annular groove that is depressed toward an inner surface of a panel section around the panel section;

a chuck wall that is formed around the annular groove while extending higher than an outer surface of the panel section;

a flange that is formed on a leading edge of the chuck wall while being curled to be seamed to an opening end a can trunk;

a buckling-inducing section that is thinned to be easily deformed angularly to protrude outwardly, and that is formed on a plurality of sites in a circumferential portion of the panel section close to the annular groove; and a score line that intersects with a virtual line passing through a center of the panel section and a center of the buckling-inducing section, and that is easily to be ruptured, wherein both end portions of the score line are situated closer to the center of the panel section than a virtual boundary line that is drawn perpendicular to the virtual line while passing through an end portion of the buckling-inducing section, a circular depression that is depressed toward the inner surface of the panel section is formed at the center of the panel section, in such a manner that a radius of the circular depression reaches neither the score line nor the buckling-inducing section, a slant wall section is formed between an outer end of the buckling-inducing section in a radial direction of the panel section and an inner side wall of the annular groove, and the slant wall section is joined to the inner side wall through a curved portion having a predetermined curvature radius to protrude outwardly from the panel section.

2. The can lid as claimed in claim 1, wherein each intersection between the score line and the virtual line is individually situated on the panel section radially outer side of the center of the buckling-inducing section on the virtual line.

3. The can lid as claimed in claim 1, wherein the curvature radius of the curved portion is 0.5 mm or longer.

4. The can lid as claimed in claim 2, wherein the curvature radius of the curved portion is 0.5 mm or longer.

* * * * *